US005702403A

United States Patent [19]

Heintke et al.

[11] Patent Number: 5,702,403

[45] Date of Patent: Dec. 30, 1997

[54] EPILATING APPLIANCE

[75] Inventors: Hans-Eberhard Heintke, Wächtersbach; Achim Flesser, Königstein, both of Germany

[73] Assignee: Braun Aktiengesellschaft, Frankfurt, Germany

[21] Appl. No.: 338,568

[22] PCT Filed: Mar. 4, 1994

[86] PCT No.: PCT/EP94/00653

§ 371 Date: Nov. 17, 1994

§ 102(e) Date: Nov. 17, 1994

[87] PCT Pub. No.: WO94/21151

PCT Pub. Date: Sep. 29, 1994

[30] Foreign Application Priority Data

Mar. 24, 1993 [DE] Germany ..... 43 09 406.6

[51] Int. Cl.[6] ..... A45D 26/00

[52] U.S. Cl. ..... 606/133; 606/131

[58] Field of Search ..... 606/131, 133; 452/75, 102, 104

[56] References Cited

U.S. PATENT DOCUMENTS 4,575,902 3/1986 Alazet .

4,960,422 10/1990 Demeester ..... 606/133

5,084,055 1/1992 Demeester ..... 606/133

5,190,559 3/1993 Gabion et al. ..... 606/133

5,261,919 11/1993 Niedertscheider ..... 606/133

5,507,753 4/1996 Iwasaki et al. ..... 606/133

*Primary Examiner*—Glenn K. Dawson

*Attorney, Agent, or Firm*—Fish & Richardson P.C.

[57] ABSTRACT

The invention is directed to an epilating appliance for the removal of human body hairs which is adapted to be held in a user's hand and guided over the sections of the skin to be treated. The epilating appliance includes a cylinder rotary about a center axis, the cylinder periphery being formed by at least one group of relatively fixed blades and at least one group Of relatively movable gripping elements. The blades and the gripping elements of a group are arranged adjacent to each other at least in pairs, and the groups are in successive arrangement on the cylinder when viewed in a direction of rotation of the cylinder. The gripping elements are adapted to approach each other and recede from each other at least in pairs, closing and, respectively, opening a gripping aperture in the process. Adjacent blades combine to form a groove of a width tapering in wedge or funnel shape, with at least one groove end section of reduced groove width being associated with one gripping aperture each.

16 Claims, 4 Drawing Sheets

EPILATING APPLIANCE

This invention relates to an epilating appliance for the removal of human body hairs which is adapted to be held in a user's hand and guided over the sections of the skin to be treated. The appliance includes a cylinder rotary about a center axis, the cylinder periphery being formed by at least one group of relatively fixed blades and at least one group of relatively movable gripping elements. The blades and the gripping elements of a respective group are arranged adjacent to each other at least in pairs, and the groups are in successive arrangement when viewed in a direction of rotation of the cylinder. The gripping elements are adapted to approach each other and recede from each other at least in pairs, closing and, respectively, opening a gripping aperture in the process.

Epilating appliances of this or a similar type are already known from the art as, for example, from the publications U.S. Pat. No. 4,575,902 A, U.S. Pat. No. 4,960,422 A or U.S. Pat. No. 5,084,055 A, which are included in the disclosure content of the present application by express reference thereto. Two types of hair removal must be distinguished, namely, the removal of hairs on the skin surface (depilation), and the removal of hairs by the roots (epilation). Motor-powered epilating appliances operate on the principle of gripping and clamping the hairs to be removed and extracting them from the skin by the roots by means of pincerlike gripping elements opening and closing at periodic intervals. Extraction is accomplished by the pincerlike gripping elements being moved away from the skin rapidly after gripping the hair or hairs. This movement of the gripping elements away from the skin may be accomplished, for example, in that the gripping elements are part of a rotary cylinder, performing periodic approaching and receding motions as the cylinder rotates.

It is a general problem in the appliances of the type initially referred to increase the efficiency while mitigating the sensation of pain experienced by the user during hair removal.

The efficiency of epilation may be improved in particular by an approach which ensures that the hairs of those sections of the skin over which the epilating appliance travels are reliably directed into the gripping apertures between the gripping elements. Not all hairs stand up straight or extend from the skin surface at right angles, rather, some of them also grow from the skin at an inclined angle or rest flat against the skin surface. To ensure that the hairs are caught by the gripping elements reliably also under such adverse circumstances, means referred to as hair-threading aids for lifting and engaging the hairs into the gripping apertures may be provided. Threading aids of this type are capable of diminishing the number of futile plucking operations, that is, closing of the empty gripping aperture, while the efficiency of the epilating appliance is increased. Such an approach aimed at improving the efficiency of the plucking system also mitigates the—highly subjective—sensation of pain experienced by its user. The physiological background of this finding is still open to explanation, but it is fairly safe to assume that the pain the user feels when, for example, ten hairs are plucked out at a time is not ten times the pain felt when a single hair is plucked out, because the pain-sensitive receptors distributed on the skin surface do not record all the simultaneous plucking operations on closely adjacent hairs as separate events. Irrespective of how exactly the theory to explain these relationships may be, examinations have shown that a user's subjective sensation of pain is the less the more effectively the epilating appliance operates. An added aspect is that the situation may also occur that hairs to be removed, whilst entering the gripping aperture between the gripping elements, are caught only in part, are pulled at a little, but not removed. Also, pulling at the hairs without removing them increases the user's sensation of pain. For this reason, an enhancement of the efficiency of the plucking system is a primary object to be solved by the epilating appliance.

Many attempts have been made in the past to improve the efficiency of epilating appliances. Thus, for example, U.S. Pat. No. 5,084,055 A describes an epilating appliance which incorporates the features initially referred to and in which an epilating cylinder rotary about a center axis includes a number of rows of gripping elements arranged on the periphery of the cylinder. On either side of the gripping elements when viewed in a direction of rotation of the cylinder, blades referred to as protective blades are provided in the area of the cylinder periphery. For one thing, these protective blades have the property of precluding skin irritation caused by the rotary gripping elements. For another thing, these protective blades have the advantage of virtually combing the hairs to be removed, bringing them into position within the free spaces between the gripping elements. Although appliances equipped with such protective blades are well proven in practice, it is desirable to increase the efficiency of the epilating appliances still further for the reasons stated above.

It is therefore an object of the present invention to devise an epilating appliance featuring an improved efficiency. In an epilating appliance incorporating the features initially referred to, this object is essentially accomplished by the present invention in that adjacent blades combine to form a groove of a width extending in wedge or funnel shape, and that at least one groove end section of reduced groove width is associated with one gripping aperture each.

As practical examinations have shown, the epilating appliance according to the present invention is of enhanced efficiency and reduces the sensation of pain during use. For one thing, this is attributable to the funnel effect, that is, the channeling end orientation of the hairs to be removed to the individual gripping aperture. On account of the groove width decreasing in the manner of a wedge or funnel, the hairs to be removed are caught over a section of the skin corresponding to the largest width of the groove, and are directed within the narrowing groove into a respective gripping aperture associated with a respective groove end section of reduced groove width. Futile plucking operations are thereby reduced. For another thing, it is a positive effect of the groove width decreasing in the manner of a wedge or funnel that the skin partially entering the groove as the cylinder rotates is arched up to different degrees on account of the progressively narrowing groove width. This arching of the skin which becomes progressively more prominent as the groove rotates by causes the skin to be stretched taut, with the attendant effect of raising the hair, thus ensuring that the hair to be removed is caught by the pair of gripping elements adjoining the groove end section of reduced width with a very high degree of reliability. This also reduces the number of operations in which only an incomplete pulling action is exerted on the hair to be removed, with the gripping elements catching it insufficiently without extraction.

In an embodiment of the present invention, each individual groove end section of reduced groove width is associated with one gripping aperture each. This arrangement has the advantage that all the hairs to be removed which the rotary cylinder is capable of grasping along its longitudinal dimension are engaged within the groove end sections of the grooves of increased width and directed into the gripping apertures of the series of gripping elements.

A particularly simple construction of a groove width decreasing in wedge or funnel shape is accomplished by providing the blades with a thickness extending substantially in wedge shape, in particular with a progressively increasing thickness.

In a further feature of the present invention, the blade thickness is essentially constant in the area of the groove end section of reduced width. Because the groove side walls extend parallel to each other over the area of the relatively short groove end section, forming a groove of constant width, the guiding of the hairs into the gripping aperture adjoining the groove end section is furthered.

In an advantageous embodiment of the present invention, two groove end sections of reduced groove width opening into the gripping aperture on either side thereof are associated with the gripping aperture between adjacent gripping elements. This arrangement proves particularly advantageous for such epilating appliances in which the cylinder is capable of reversing its direction of rotation. Depending on the direction of cylinder rotation, the hairs to be removed are fed into the gripping aperture through either the one or the other groove opening into the gripping aperture on either side thereof.

Advantageously, the groove width is at a maximum value in a cylinder peripheral area diametrically opposite the gripping elements, or in a center section of the cylinder peripheral area located between groups of gripping elements.

Both in this embodiment and in all other embodiments, the blades are of an extremely thin configuration in the area where the groove width is at a maximum value, so that the hairs to be removed are caught in the grooves practically along the entire longitudinal dimension of the cylinder and are fed into the gripping apertures of the gripping elements through the grooves progressively narrowing in wedge shape, with the gripping apertures covering only a fraction of the longitudinal dimension of the cylinder. The number of hairs directed at the gripping apertures per unit of length (related to the cylinder) is increased by the compressing or channeling action of the grooves narrowing in the manner of a wedge, with the added effect that these hairs are reliably guided into the proper gripping aperture.

In particular for appliances having n groups of blades and n groups of gripping elements, where n=2, 3, . . . , which are disposed on the cylinder periphery successively in alternating sequence, it has proven to be advantageous that the groove formed by the adjacent blades of a group has its groove end section associated with a respective gripping aperture of adjacent gripping elements of the subsequent group of gripping elements. This thus provides the possibility of associating each gripping aperture formed by the gripping elements with a groove of a width tapering in wedge shape or at an acute angle, also in cases where, for example, several rows of gripping elements are arranged on the cylinder periphery. Therefore, the advantage achievable with the present invention can also be accomplished with epilating appliances having several groups of gripping elements.

Because the blades of the nth group and the gripping elements of the nth group are disposed on the cylinder periphery in offset relation to the blades of the (n+1)th group and the gripping elements of the (n+1)th group, the hairs to be removed are caught by the various groups of gripping elements at different locations on the skin on a single revolution of the cylinder, thereby further increasing the efficiency in connection with the associated grooves tapering in wedge shape.

In this arrangement, the amount of offset of the blades and gripping elements of the nth group in relation to the (n+1)th group is advantageously dimensioned such that this amount is equal to the mean groove distance between adjacent grooves divided by n. This configuration of the present invention ensures a uniform distribution of the effective gripping apertures of the gripping elements related to the longitudinal dimension of the cylinder.

In a highly advantageous further feature of the present invention, one or several blades of one or several groups include one or several tooth-shaped recesses at least in partial areas along the cylinder periphery, the recesses extending preferably down to the bottom of the groove. These tooth-shaped recesses exert a combing action on the hairs to be removed that are lying across the grooves or flat against the skin, as a result of which the hairs are introduced between the recesses into the groove through the individual webs of the blades which, under circumstances, are of different widths, and are then fed into the individual gripping apertures as described in the above.

In this arrangement, it has proved to be an advantage that the blades are provided with these tooth-shaped recesses in a groove end section of increased groove width.

In another advantageous feature of the present invention, partial sections of the blades are formed by rollers configured in particular in the shape of disks. The use of such rollers which are preferably mounted so as to rotate freely reduces friction between the skin and the cylinder and thus the risk of skin irritation, it improves the guiding of the cylinder as it travels over the skin and, where applicable, also lifts any hairs resting against the skin surface to guide them into the associated gripping apertures through the intermediary of the grooves.

Advantageously, the rollers are part of an axle freely rotatably mounted on the cylinder essentially parallel to the cylinder center axis. Owing to this configuration, a plurality of adjacent rollers requires only two bearing points on the cylinder, with the axle on which the rollers are provided being adapted to be located on the cylinder preferably by snapping or locking means.

As regards the mode of function of the rollers in combination with an optimum configuration of the structural dimensions, it has proven advantageous to arrange the axle on the cylinder at such a radial distance to the cylinder center axis which is smaller than, or approximately equal to, the distance between the bottom of the groove and the center axis.

In a further embodiment of the present invention, the blades of each group form part of a component of a profile shaped substantially in the manner of a sector or segment of a circle, the component being arranged on the cylinder adjacent to the gripping elements or embracing the gripping elements laterally.

Further features, advantages and application possibilities of the present invention will become apparent from the subsequent description of embodiments illustrated in more detail in the accompanying drawings. It will be understood that all features described and/or represented by illustration, whether taken alone or in any desired combination, constitute the subject-matter of the present invention, irrespective of their summarization in the claims or their back-references.

IN THE DRAWINGS

Figure 1:
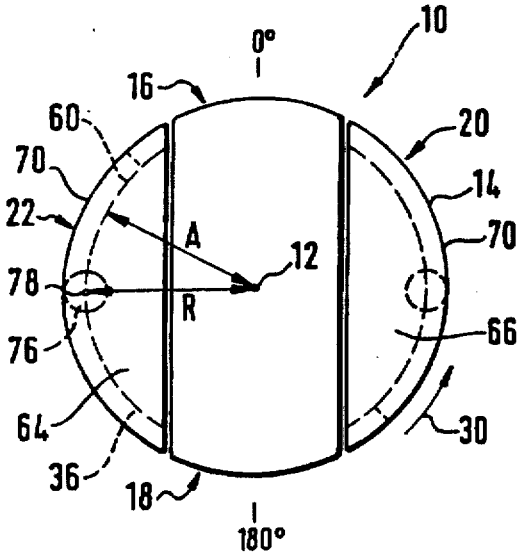
FIG. 1 is an end view of the cylinder illustrating schematically a first embodiment of the present invention.
Figure 4A:
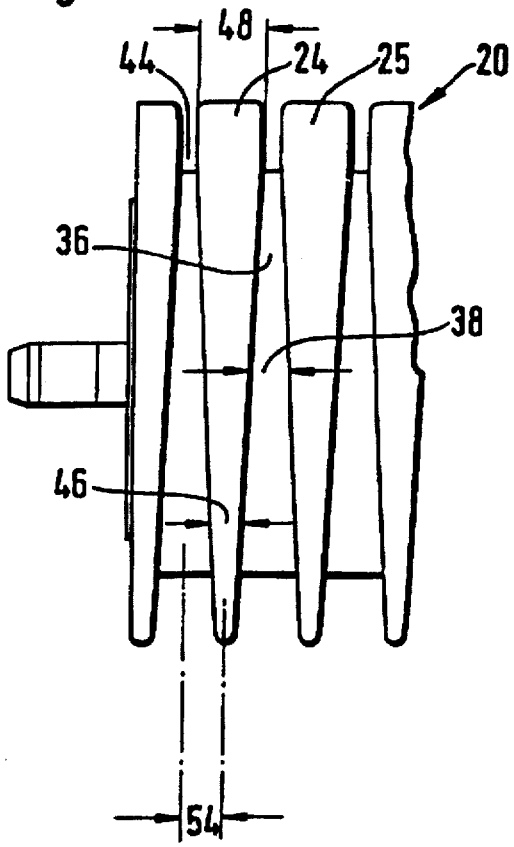
Figure 5:
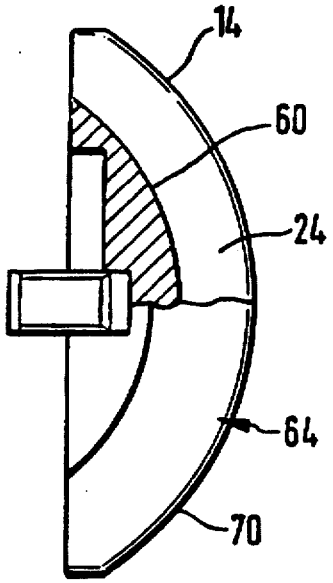
Figure 4B:
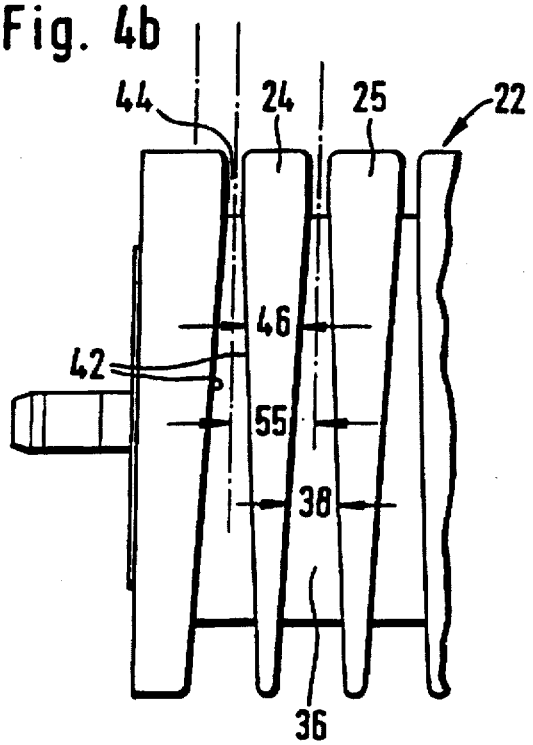
Figure 6:
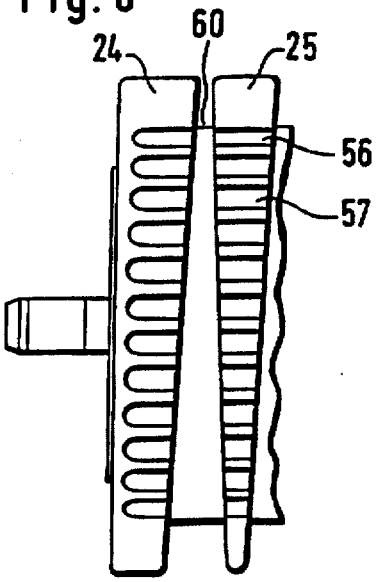
Figure 7:
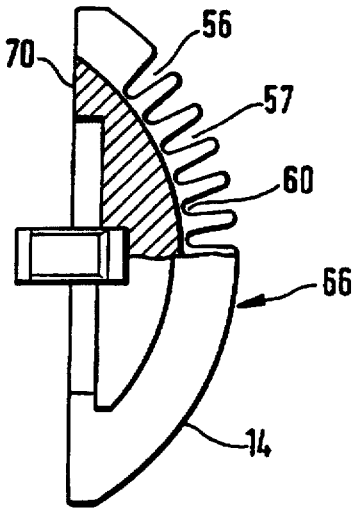
Figure 8:
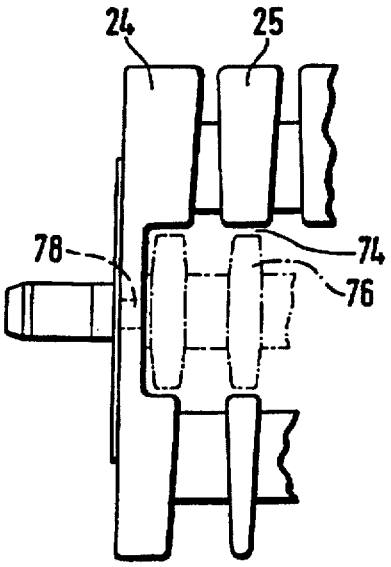
Figure 9:
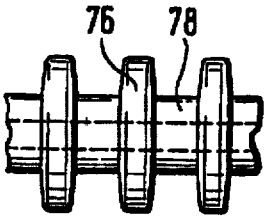
Figure 10:
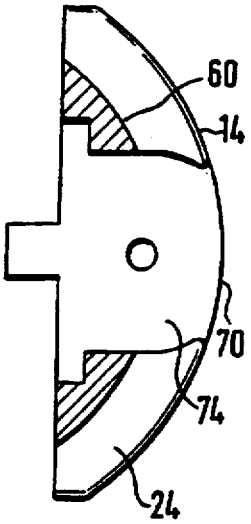
Figure 11A:
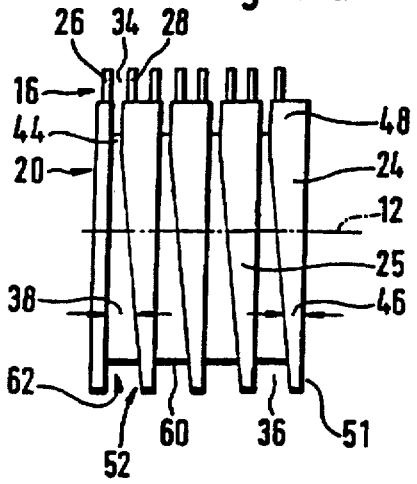
Figure 11B:
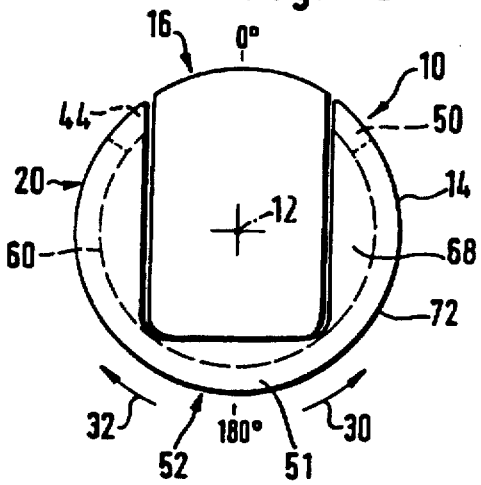
Figure 12A:
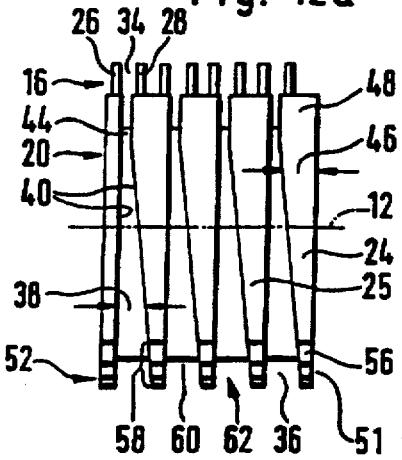
Figure 12B:
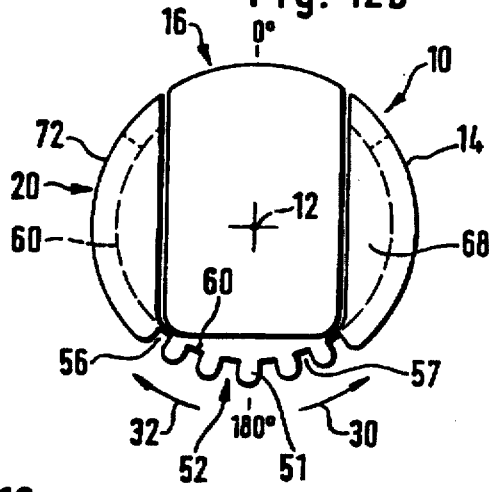
Figure 13:
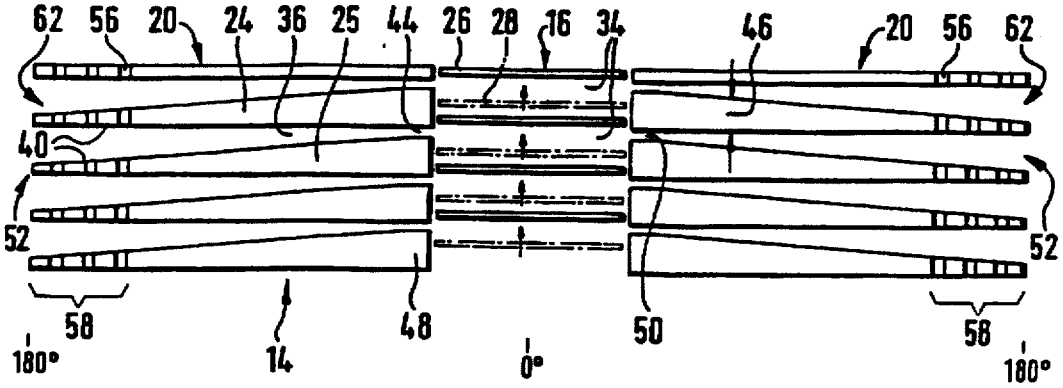

FIGS. 4*a*, *b* are side views of the blade-carrying components of the cylinder of FIG. 1;

FIG. 5 is an end view of the component of FIG. 4*a*;

FIG. 6 is a view of a further embodiment of the component of FIG. 4*b*;

FIG. 7 is an end view of the component of FIG. 6;

FIG. 8 is a view of the component of FIG. 4*b* illustrating a further embodiment of the present invention;

FIG. 9 is a view of the rollers of FIG. 8 mounted on an axle;

FIG. 10 is an end view, partly sectioned, of the component of FIG. 8;

FIGS. 11*a*, *b* are a side view and an end view, respectively, of the cylinder illustrating schematically a further embodiment of the present invention;

FIGS. 12*a*, *b* are a side view and an end view, respectively, of the cylinder illustrating schematically a still further embodiment of the present invention; and FIG. 13 is a developed view of the periphery of the cylinder of FIGS. 11 and 12.

In the Figures, embodiments of the present invention are illustrated purely schematically omitting structural details or particulars. An overview of the functional structure or mode of operation of the epilating appliance, the manner of actuation of the gripping blades and the drive mechanism of the rotary cylinder is given, for example, in the prior art initially referred to. The subsequent description of embodiments of the present invention relates substantially to the configuration of the cylinder with regard to the arrangement of the blades and their relative association with the gripping elements.

In an epilating appliance not shown in the Figures, a rotary cylinder 10 is mounted so as to be rotatable about a center axis 12. The periphery 14 of the cylinder 10 is formed by one or several groups 20, 22 of relatively fixed blades 24, 25 and one or several groups 16, 18 of relatively movable gripping elements 26, 28. In this arrangement, the blades 24, 25 and the gripping elements 26, 28 of a group 20, 22 and, respectively, 16, 18 are arranged in pairs and in rows adjacent to each other. The groups 20, 16, 22, 18 are successively arranged on the cylinder periphery 14 when viewed in a direction of rotation 30, 32 of the cylinder 10, so that a row of gripping elements 26, 28 is followed by a row of blades 24, 25. The gripping elements 26, 28 are adapted to approach one another and to recede in pairs, with a gripping aperture 34, 35 being opened and closed in the process.

A groove 36 is formed between adjacent blades 24, 25 on the cylinder 10. The width 38 of the groove 36 diminishes in the shape of a wedge or funnel. A groove end section 44, 50 of diminished groove width 38 is associated with a respective gripping aperture 34, 35. The other groove end section 62 has an increased groove width 38. The blades 24, 25 are of a progressively increasing thickness 46 when viewed in the direction of rotation 30, 32 of the cylinder 10.

In the area of the groove end section 44, 50, the blade thickness 48 is essentially constant, so that the groove 36 formed by two blades 24, 25 is of a constant groove width 38 in the area of the groove end section 44, 50.

According the embodiment of FIGS. 11, 12 and 13, two groove end sections 44, 50 of diminished groove width 38 are associated with adjacent gripping elements 26, 28. The groove end sections 44, 50 open into the gripping aperture 34 on either side of the gripping elements 26, 28. The groove width 38 is at its maximum in a peripheral area 52 diametrically opposite the gripping elements 26, 28.

Figure 2:
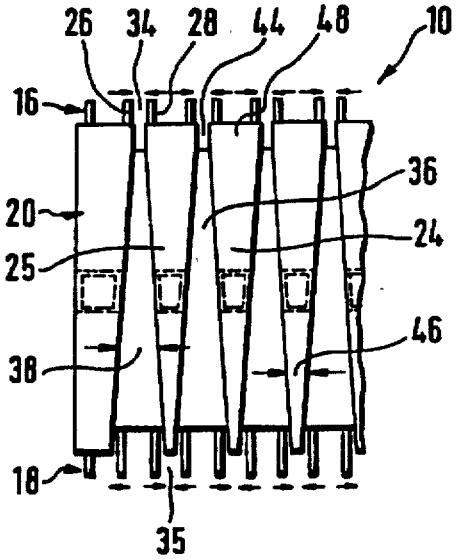
FIG. 2 is a partial side view of the periphery of the cylinder of FIG. 1.
Figure 3:
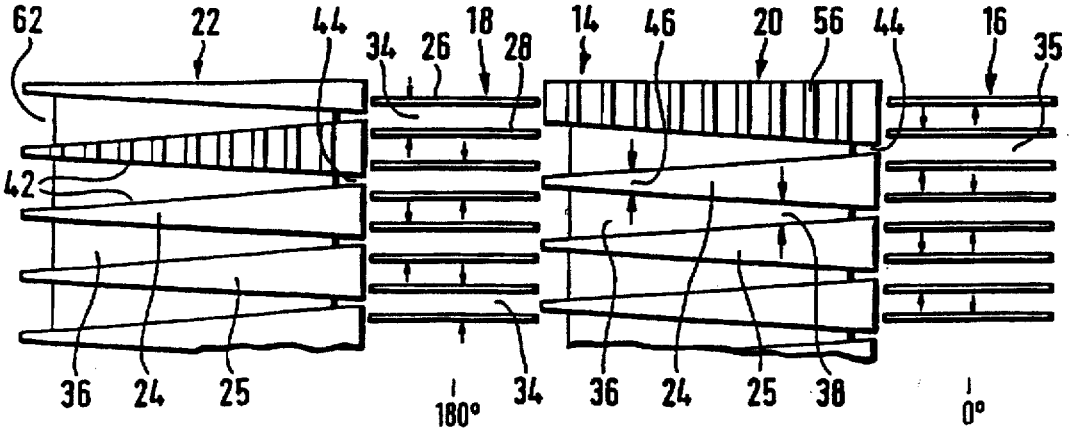
FIG. 3 is a partial developed view of the periphery of the cylinder of FIG. 1.

In the embodiment of FIGS. 1 to 3, two groups 20, 22 of blades 24, 25 and two groups 16, 18 of gripping elements 26, 28 are successively disposed on the cylinder periphery 14 in alternating sequence. In this arrangement, the groove 36 formed by adjacent blades 24, 25 of a group 20, 22 has its groove end section 44 associated with a respective gripping aperture 34, 35 of adjacent gripping elements 26, 28 of the subsequent group 16, 18 of gripping elements 26, 28. The groove width 38 is at its maximum in the groove end section 62. As becomes apparent particularly from FIGS. 3 and 4, the blades 24, 25 of the first group 20 and the gripping elements 26, 28 of the first group 16 are disposed on the cylinder periphery 14 in offset relation to the blades 24, 25 of the second group 22 and the gripping elements 26, 28 of the second group 18. The amount of offset 54 (FIG. 4) of the blades 24, 25 and gripping elements 26, 28 of the respective groups 16 to 22 is equal to the mean groove distance 55 of adjacent grooves 36 divided by 2.

One or several blades 24, 25 of one or several groups 20, 22 include one or several tooth-shaped recesses 56, 57 at least in partial areas 58 along the cylinder periphery 14. The recesses 56, 57 extend generally down to the bottom 60 of the groove 36. As indicated, for example, in FIG. 12, the tooth-shaped recesses 56, 57 are arranged in a groove end section 62 of increased groove width 38. However, the possibility exists also to provide the blades 24, 25 with tooth-shaped recesses 56, 57 along their entire length (FIGS. 6, 7).

As becomes apparent from FIGS. 8 to 10, partial sections 74 of the blades 24, 25 are formed by rollers 76 configured in the shape of disks. The rollers 76 are part of an axle 78 freely rotatably mounted on the cylinder 10 essentially parallel to the cylinder center axis 12. The axle 78 is arranged at such a radial distance R to the center axis 12 of the cylinder 10 which is smaller than, or approximately equal to, the distance A between the bottom 60 of the groove 36 and the center axis 12.

In dependence on the number of groups 16 to 22 arranged on the cylinder 10, the blades 24, 25 of each group 20, 22 form part of a component 64, 66, 68 of a profile 70, 72 shaped substantially in the manner of a sector or segment of a circle, the component being arranged on the cylinder 10 adjacent to the gripping elements 26, 28 (as in FIG. 1), or embracing the gripping elements 26, 28 laterally (as in FIG. 11*b*).

We claim:

1. An epilating appliance for the removal of body hairs, comprising:

a cylinder having a central axis about which the cylinder rotates, an outer surface of the cylinder including a pair of relatively fixed blades and a pair of relatively movable gripping elements, the pair of fixed blades defining a funnel-shaped groove therebetween having a first end section of relatively increased width and a second end section of relatively reduced width, the groove being oriented along a direction of rotation of the cylinder, the pair of gripping elements defining a gripping aperture therebetween of substantially constant width oriented along the direction of rotation of the cylinder, the gripping aperture being circumferentially aligned with the groove, the pair of gripping elements being adapted to approach each other and recede form each other such that movement of the pair of gripping elements closes and opens the gripping aperture.

2. The epilating appliance of claim 1 further comprising:

a first plurality of pairs of fixed blades including said pair of fixed blades, said first plurality of pairs of fixed blades oriented in a stacked configuration, each pair of fixed blades defining a funnel-shaped groove therebetween having a first end section of relatively increased width and a second end section of relatively reduced width, the groove being oriented along a direction of rotation of the cylinder, and a first plurality of pairs of gripping elements including said pair of gripping elements, said first plurality of pairs of gripping elements oriented in a stacked configuration, each pair of gripping elements defining a gripping aperture therebetween of substantially constant width oriented along the direction of rotation of the cylinder, each gripping aperture being circumferentially aligned with a respective groove, each pair of gripping elements being adapted to approach each other and recede form each other such that movement of each pair of gripping elements closes and opens the respective gripping aperture.

3. The epilating appliance of claim 2 wherein the fixed blades are substantially funnel-shaped.

4. The epilating appliance of claim 3 wherein the blade thickness is essentially constant in a limited area near the second end section of the groove.

5. The epilating appliance of claim 2 wherein the second end section of each groove is juxtaposed at an end of the respective gripping aperture.

6. The epilating appliance of claim 5 further comprising a second plurality of pairs of fixed blades oriented in a stacked configuration, each pair of the second plurality of pairs of fixed blades defining a funnel-shaped groove therebetween having a first end section of relatively increased width and a second end section of relatively reduced width, the groove being oriented along a direction of rotation of the cylinder, each groove being circumferentially aligned with a respective gripping aperture of each pair of gripping elements, the second end section of each groove being juxtaposed at a second end of the respective gripping aperture.

7. The epilating appliance of claim 2 further comprising:

at least a second plurality of pairs of fixed blades oriented in a stacked configuration, each pair of the second plurality of pairs of fixed blades defining a funnel-shaped groove therebetween having a first end section of relatively increased width and a second end section of relatively reduced width, the groove being oriented along a direction of rotation of the cylinder, and at least a second plurality of pairs of gripping elements oriented in a stacked configuration, each pair of the second plurality of pairs of gripping elements defining a gripping aperture therebetween of substantially constant width oriented along the direction of rotation of the cylinder, each gripping aperture of each pair of the second plurality of pairs of gripping elements being circumferentially aligned with a respective groove of each pair of the second plurality of pairs of fixed blades, each pair of the second plurality of pairs of gripping elements being adapted to approach each other and recede form each other such that movement of each pair of the second plurality of pairs of gripping elements closes and opens the respective gripping aperture.

8. The epilating appliance of claim 7 wherein the fixed blades of the first plurality of pairs of fixed blades are disposed on the outer surface of the cylinder in offset relation to the fixed blades of the second plurality of pairs of fixed blades.

9. The epilating appliance of claim 8 wherein the offset is equal to a mean groove distance between adjacent grooves divided by how many plurality of pairs of fixed blades comprise said first plurality of pairs of fixed blades.

10. The epilating appliance of claim 1 wherein at least one of said pair of fixed blades includes a tooth-shaped recesses.

11. The epilating appliance of claim 10 wherein the tooth-shaped recesses are located at the first end section of the groove.

12. The epilating appliance of claim 1 wherein a section of each fixed blade comprises a disk-shaped roller.

13. The epilating appliance of claim 12 wherein the rollers are integral with an axle freely rotatably mounted on the cylinder and oriented parallel to the cylinder central axis.

14. The epilating appliance of claim 13 wherein the axle is arranged at a radial distance to the central axis of the cylinder which is not greater than a distance between a bottom of the groove and the central axis.

15. The epilating appliance of claim 1 wherein the pair of fixed blades is integral with a sector-shaped component, the component being arranged on the cylinder adjacent to the pair of gripping elements.

16. The epilating appliance of claim 1 wherein the pair of fixed blades is integral with a sector-shaped component, the component being arranged on the cylinder embracing the pair of gripping elements laterally.

* * * * *